US005160208A

United States Patent [19]

Lockhart

[11] Patent Number: 5,160,208

[45] Date of Patent: Nov. 3, 1992

[54] LOOSE LEAF BINDER REVISION DEVICE AND METHOD OF USING SAME

[75] Inventor: John E. Lockhart, Plainfield, Ill.

[73] Assignee: Revision Qix, Ltd., Chicago, Ill.

[21] Appl. No.: 585,302

[22] Filed: Sep. 19, 1990

[51] Int. Cl.[5] ..... B42F 13/00

[52] U.S. Cl. ..... 402/24; 402/80 R; 402/31

[58] Field of Search ..... 402/31, 32, 80 R, 24, 402/25, 5, 60; 40/530

[56] References Cited

U.S. PATENT DOCUMENTS

| | | | |
|---|---|---|---|
| 764,502 | 7/1904 | Robson et al. | 402/45 |
| 805,575 | 11/1905 | Morden | 402/68 |
| 1,091,986 | 3/1914 | Tragardh | 402/80 R |
| 1,344,971 | 6/1920 | Allison | 402/80 R |
| 2,093,041 | 9/1937 | Emery | 402/45 |
| 2,180,892 | 11/1939 | Adams | 402/80 R |
| 2,236,321 | 3/1941 | Ostrander | 370/27 |
| 2,322,180 | 6/1943 | Vernon | 402/20 |
| 2,329,351 | 9/1943 | Korvin-Kroukovsky | 402/24 |
| 3,785,740 | 1/1974 | Strong | 402/29 |

FOREIGN PATENT DOCUMENTS

| | | |
|---|---|---|
| 636112 | 12/1978 | U.S.S.R. . |
| 163891 | 6/1921 | United Kingdom . |

*Primary Examiner*—Joseph M. Gorski
*Assistant Examiner*—S. Thomas Hughes
*Attorney, Agent, or Firm*—Potthast & Ring

[57] ABSTRACT

A quick revision apparatus (22) and method for guiding loose leaf documents (12) across a gap (11) between a pair of mating binder ring members (3A and 3B) to facilitate quick revision of a set of documents (12) held thereby having a pivotally mounted bridge (6A) for spanning the gap (11) which is moved to an operative position by movement of a leaf element (12) thereon from one of the ring members (3B) to the other ring member (3A).

27 Claims, 2 Drawing Sheets

LOOSE LEAF BINDER REVISION DEVICE AND METHOD OF USING SAME

BACKGROUND OF THE INVENTION

This invention generally relates to loose leaf binders and, more particularly, to apparatus and methods for facilitating quick revisions of sets of loose leaf elements bound by such binders.

Loose leaf binders of various designs have long been known as shown by U.S. Pat. Nos. 764,502 issued Jul. 5, 1904 to Robson et al.; 805,575 issued Nov. 28, 1905 to Morden; 2,236,321 issued Mar. 25, 1941 to Ostrander; 2,322,180 issued Jun. 15, 1943 to Vernon and 3,785,740 issued Jan. 15, 1974 to Strong.

The most common form of such binders generally comprise an elongate backing, or rib, intermediate a pair of pivotally connected covers which carries therebetween a loose leaf binder assembly comprising a plurality, such as two or three, aligned binder rings. Each of these binder rings are generally defined by a pair of arcuate rings, or loop, elements which are mounted for pivotal movement between an open position and a closed position. In the open position there is a gap between the free ends of the mating pair of right and left ring members to enable insertion of the ring members through mating, aligned mounting holes adjacent the edges of the loose leaf elements, such as paper documents or the like. After the loose leaf elements are mounted to either the right or the left side ring members by sliding the loose leaf mounting holes over the ends of the ring, the mating pairs of right and left loop members are moved to the closed position in which the ends of the mating pairs of ring members abut to form a continuous loop which binds, i.e. blocks removal of the loose leaf elements from off the free ends of the ring members. Typically, the mating pair of ring members are spring biased both toward the open position when open and toward the closed position when closed. An example of this general type of loose leaf ring binder construction is shown in the aforementioned patent 2,236,321 of Ostrander.

Other types of construction are also known. For example in the aforementioned patent 805,575 of Morden, the gap of a split book ring is selectively opened and closed by means of a locking sleeve slideably mounted to the split ring for movement between a closed position in which the sleeve closes, or bridges, the gap to prevent removal of loose leaf elements, to an open position in which the gap is not closed and the opposite ends of the ring are exposed for addition and removal of the loose leaf elements. Similarly, in the aforementioned Pat. Nos. 764,502 of Robson and 2,322,280 of Vernon , a split ring is rotatably mounted to a member parallel to the rib for movement between a position in which the gap in the ring is blocked by the parallel member to a position in which it is open for removal of selected loose leaf documents. Another type of construction is illustrated in the aforementioned U.S. Pat. Nos. 2,093,041 of Emery and 3,785,740 of Strong in which part of an upper position of a binding ring is pivotally mounted for movement away form the interior of the loop formed by the ring to open and close a gap.

The advantage of loose leaf binders, relative to other types of fixed or nonloose leaf binders, such as glued book binders, spiral binders or the like, is that they facilitate revision of the set of loose leaf documents or elements being bound thereby. This revision, either removal or substitution of loose leaf documents already bound or addition of new loose leaf documents, can be done selectively at any relative location in the set of loose leaf elements. This is achieved by turning the loose leaf elements from one side to the other until the desired location within the set of loose leaf elements is reached at which the document to be removed, for instance, is positioned at a location closest to, or adjacent to, the point of juncture of the relatively movable ring members or, in the case of a split ring construction, closest to the gap. In the case of the most common construction employing a pair of movable ring, or loop, members, the loose leaf elements are simply turned from one side, in binding relationship with one of the loop elements, to the other side in binding relationship with the other loop member. Then the ring members are moved to an open position to create the gap needed for removal or insertion of the loose leaf elements at the top of the stack on either side of the rib, i.e., those attached to the left loop member and those attached to the right loop member.

While this is a considerable advantage over nonloose leaf binders, it sill demands a substantial number of repetitive steps in order to make substantial revisions which are often required. Such loose leaf binders are commonly employed for binding sets of legal opinion reporting documents, governmental and internal company regulations and aviation documents, such as so called "Jeppsen Charts", and the like, maintained by various libraries, other organizations and individuals, such as aviation pilots.

These sets of documents must be revised, or updated, on a periodic basis—annually, quarterly, monthly, and, in some cases, such as aviation "Jeppsen Charts", the sets of documents must be updated weekly. These revisions are accomplished by periodically providing the subscribers sub-sets of substitute pages which are to be randomly distributed throughout the original set of documents. Such sub-sets of substitute documents can contain hundreds of pages or groups of consecutive pages which must be substituted one page or one group at a time.

Unfortunately, the known loose leaf binders provide only one means for accomplishing these substitutions, and this means is tedious, labor intensive, noisy and creates undue wear and tear on the ring binding assembly. In the case of conventional spring biased ring binders, the covers are opened and lain on a horizontal surface. Then the pages of the bound document are turned from one side at which a stack is bound by one of the ring members to the other side at which a stack is bound to the other ring member, until the desired page to be removed, substituted or supplemented is located on top of either the left hand or right hand stack of documents. The ring binder is then snapped open to create a gap, and the removal, substitution or supplementation is performed.

After this first substitution, since there is no means to guide documents from one side to the other side across the gap when the binder is open, the ring binder must be snapped shut, so the pages can be turned from one side, or one binder element, to the other side, or other binder element, until the next page location selected for revision is reached. The ring binder is then snapped open, and the revision process as described above is repeated. For each subsequent revision location, this process of closing the binder, turning the pages to the revision location and opening the binder to enable the removal or addition of the loose leaf elements, must be repeated. If there are hundreds of separate revisions, then the binder must be snapped open and snapped closed hundreds of times.

SUMMARY OF THE INVENTION

It is therefore the object of the present invention to provide a loose leaf binder revision apparatus and method which overcomes the above problem of known loose leaf binders and, more specifically, which enables revisions of loose leaf elements without need for repetitively opening or closing the ring binder for each revision location in the set of bound documents.

In particular it is an object to provide an apparatus for facilitating the quick revision of a bound set of ordered loose leaf elements releasably held together by a binding loop extending through mounting holes of the loose leaf elements adjacent edges thereof and having a pair of mating loop members movable between a closed position in which they are engaged with each other to close the binding loop, with the edge of the loose leaf elements held together at the interior of the loop, and an open position in which ends of the mating loop members are spaced from each other to enable removal of the edges of the loose leaf elements from the interior of the loop, in which the need to repetitively open and close the binder is eliminated. This revision apparatus comprises a bridge for spanning the ends of the mating loop members when they are in said open position including a movable bridge section and means for mounting the movable bridge section to the end of the one of said mating loop elements for pivotal movement relative thereto between an open position and a closed position.

In the open position the bridge member extends from the end of the one mating loop away from the end of the other mating loop element and the ends of the mating loop members are not substantially spanned by the bridge to enable sliding removal of the loose leaf elements from off the end of the other one of said mating loop elements. In the closed position the ends of the mating loop members are substantially spanned by the bridge to enable sliding movement of the loose leaf elements from the end of the one mating loop member, across the bridge, and onto the other one of said mating loop members.

More generally, it is an object to provide a method of revising a set of leaf elements releasably bound by means of a loop passing through a hole in each of the leaf elements defined by a pair of loop members movable relative to each other between a closed position, in which the movable loop members are joined to close the loop for preventing removal of the leaf members, and an open position, in which there is a gap between the movable loop members to enable binding and removal of leaf members from the loop, in which the need for closing the binder to move loose leaf elements from one side to the other is eliminated. Instead, according to the method, the leaf elements are mechanically guided across the gap from one loop member to the other loop member and the leaf elements are moved across the gap while being guided until a selected leaf member is located on a selected loop member adjacent the gap. Then at least one of the steps of removing the selected leaf element from the selected loop member and binding a new leaf element to the selected loop member are selectively performed. Preferably, the step of mechanically guiding the leaf members across the gap is achieved by means of a movable bridge across the gap in response to a leaf member being slid thereacross.

Thus, it is also an object to provide a loose leaf binder revision apparatus for facilitating the insertion and removal of leaf members in binding relationship with a loop extending through a mating hole in each of the leaf members defined by a pair of loop members movable relative to one another between closed position, in which they are joined to prevent removal of the leaf members, to an open position, in which there is a gap between the loop members, to enable insertion and removal of leaf members in binding relationship therewith, comprising means, when actuated, for mechanically guiding the leaf elements across the gap from one loop member to the other loop member and means for actuating the guiding means to an operative condition in response to movement of a leaf element across the gap.

BRIEF DESCRIPTION OF THE DRAWINGS

The foregoing objects and advantageous features of the invention will be explained in greater detail and others will be made apparent from the detailed description of the preferred embodiment of the present invention which is given with reference to the several figures of the drawing, in which.

DETAILED DESCRIPTION

Figure 1A:
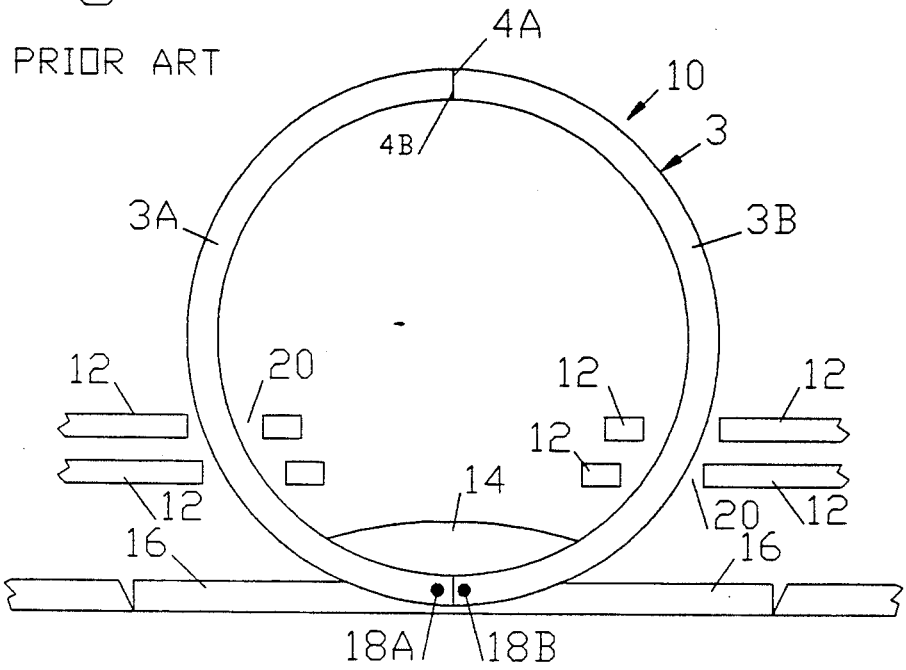
Fig.1A PRIOR ART
FIG. 1A is an end view of a ring of a prior art ring binder in a closed position.
Figure 1B:
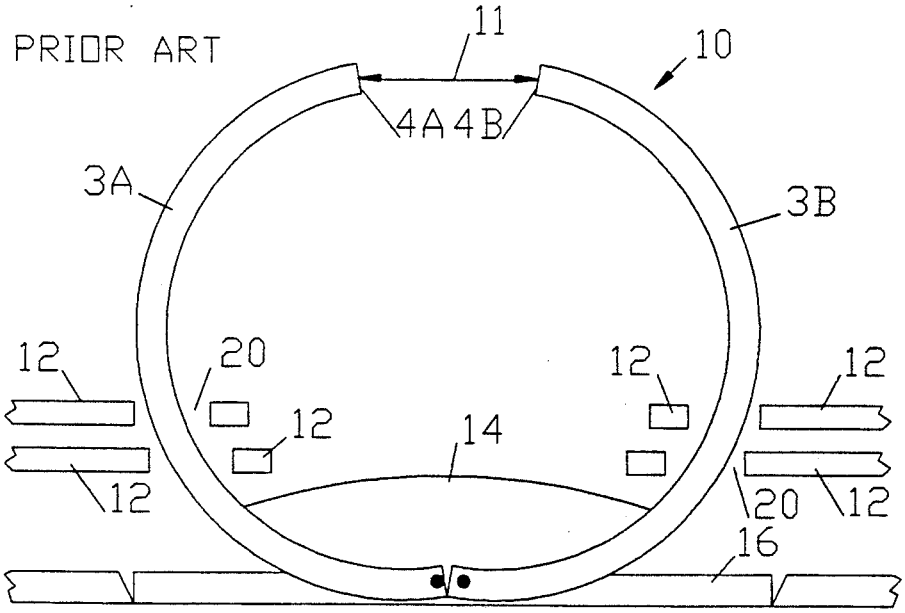
Fig.1B PRIOR ART
FIG. 1B is an end view of the prior art binder ring of FIG. 1A in an open position with a gap therebetween.
Figure 2:
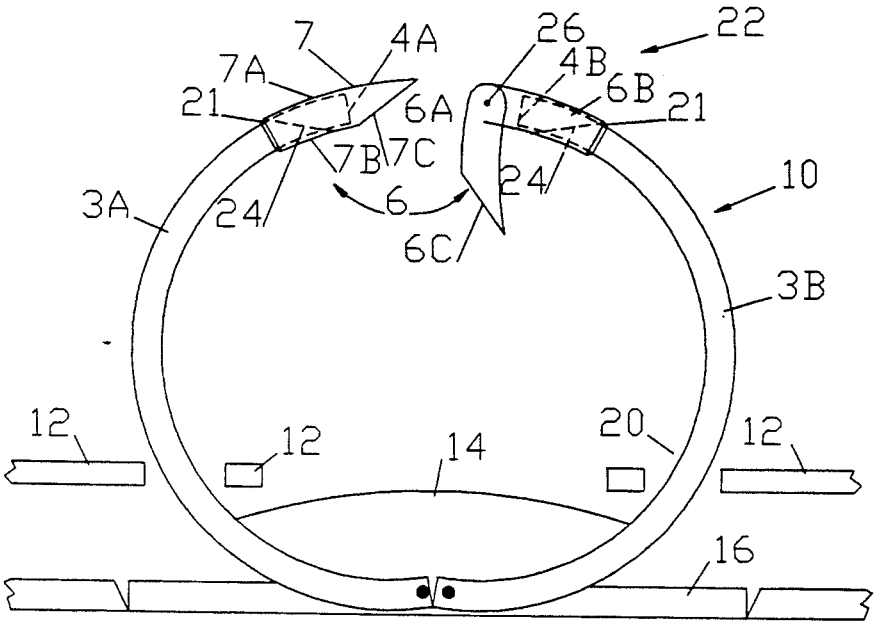
FIG. 2 is an end view of a ring of a ring binder which incorporates a preferred embodiment of the revision apparatus of the present invention when not actuated for guiding a leaf across the gap.

FIGS. 1A and 1B show a prior art loose leaf ring binder of the type useable with the revision device of the present invention. Referring to FIG. 1A, a ring binder 10 is shown in closed position with a pair of arcuate ring sections, or mating loop members, 3A and 3B having their ends, 4A and 4B abut in order to form a continuous binding loop, or ring, 3. The binding loop 3 retains a plurality of loose leaf elements 12 bound in the binder by virtue of the loop 3 passing through binding holes 20. The binder 10 has a pair of pivot axles 18A and 18B to which the loop members 3A and 3B are respectively mounted for pivotal movement between the closed position shown in FIG. 1A and the opened position shown in FIG. 1B. The left and right axles 18A and 18B are mounted to an elongate backing, or rib, 16 which carries a plurality, two or three or more, of these rings in alignment. The mating loop members 3A and 3B are biased by a spring assembly 14 toward the open position, FIG. 1A, when the binding loop 3 is open and toward the closed position, FIG. 1B, when the loop 3 is closed.

Referring to FIG. 1B, the continuous binding loop 3 must be opened in order to allow insertion or removal of the leaf elements 12. When in the open position, a gap 11 is created between the free ends 4A and 4B of the mating loop members 3A and 3B. The loose leaf elements 12 are bound by placing loop member ends 4A and 4B and the loop members 3A and 3B through the binding holes 20 of the leaf members 12. The leaf members 12 are removed by sliding the bound leaf element 12 on the top of the left stack 12A, or on top of the right stack 12B, off the loop member 3A or 3B and into the gap 11 between the movable loop members 3A and 3B. In order to make revisions (i.e. insertion or removal of additional leaf members 12 at different relative locations within the binder) the movable loop members 3A and 3B must be closed. Then, the bound leaf members 12 are circulated around the continuous loop 3 until the desired location for insertion or removal is found between the left stack 12A and right stack 12B. In order to insert or remove a desired leaf element 12, the loop members 3A and 3B are then opened, and the revision is made. In order to bind or remove a leaf 12 at another location, the loop 3 is closed and the leaf members 12 are again turned from one stack 12A or 12B to the other until the desired position is reached; then the loop members 3A and 3B are opened again to permit removal or insertion. The loop members 3A and 3B are then closed and the left member 12 turned to the next revision location, and so on.

Figure 3:
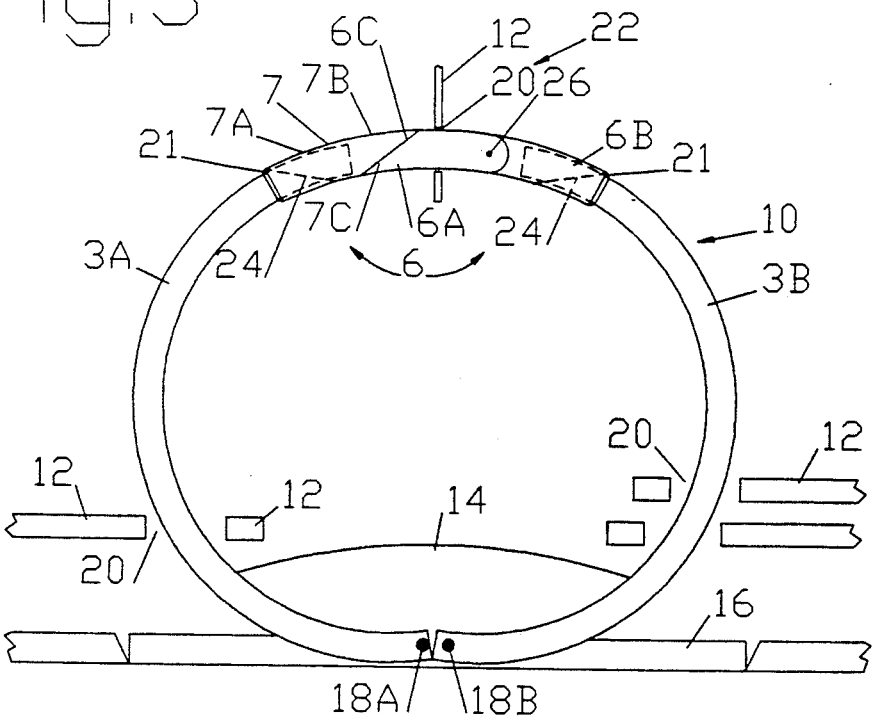
FIG. 3 is an end view of the ring of a ring binder of FIG. 2 in which the preferred embodiment of the removal apparatus is shown when actuated to guide a leaf across the gap between the mating ring members.

Referring to FIG. 3, the preferred embodiment of the binder revision apparatus 22 is preferably used in association with the loop members 3A and 3B of a loose leaf binder 10 of the type shown in FIGS. 1A and 1B. The revision apparatus 22 is comprised of a bridge 6 with a movable section 6A pivotally mounted to a mounting member 6B which, in turn, is mounted to an end, end 4B, for instance, of one of the loop members 3B. The mounting member 6B is hollow and preferably is slidably attached over the end 4B of loop member 3B. Referring to FIG. 3, the bridge 6, when in the closed position, closes, and thereby guides, the loose leaf elements 12 across, the gap 11. Although, the bridge 6 could be spring loaded to move to an open position above the loop 3, preferably gravity returns it to an open position when it is not being held in the closed position by a leaf 12 being slid thereacross as shown in FIG. 3.

Preferably, the bridge 6 includes a mating bridge section 7 which has one end 7A, slidably, removably mounted onto the other one of the mating loop members 3A and a free end 7B which has a beveled surface 7C to matingly overlap with a beveled surface 6C of the movable bridge section 6A to prevent overtravel.

While the bridge section 6A and 7 are removably mounted to the loop members 3A and 3B, alternatively, they are permanently fixed onto, or integrally formed with, the mating loop members 3A and 3B. In said event, the mating surface 7C mates with another surface of mounting member 6B.

The mounting members 7A and 6B have peripheral edges 21 surrounding the loop members 3A and 3B which preferably gradually extend inwardly. These gradually extending, or beveled, edges 21 of the mounting members reduce catching of the edges of the leaves 12 adjacent the mounting holes 20 as the leaf elements 12 are slid across the bridge 6A and bridge section 7. Optionally, as shown by broken lines 24, the undersides of the mounting members 7A and 6B are also beveled to reduce catching of the leaf members 12.

As seen in FIG. 3, the bridge 6 acts as a guide for the loose leaf members 12 to be slidably moved across the gap 11. The bridge section 6A is pivotally lifted and mated with the other bridge section 7 as a leaf member 12 is manually slid across the bridge 6. When the leaf element 12 is moved in this manner, the gap is closed and a bridge is formed. When released, gravity causes the bridge section 6A to return to a substantially open position after a leaf element 12 has been moved across the gap 11. The guiding of the leaf elements 12 across the gap from one loop member 3A to the other loop member 3B, for instance, until a selected relative position is located without repetitively opening and closing the ring binder provides for quick revisions.

Thus, it should be understood that in accordance with the method of the present invention, revising the set of leaf elements 12 is accomplished by mechanically guiding a leaf element 12 across the gap 11 from one loop member 3B to the other loop member 3A. The leaf elements 12 are successively guided across the gap 11 until a selected leaf member 12 is adjacent to the gap 11. Finally, the selected leaf member 12 is removed from the selected loop member 3A or 3B or a new leaf element is bound to the selected loop member 3A or 3B.

While a particular embodiment has been described in detail, it should be appreciated that many variations may be made thereto without departing from the scope of the invention as defined in the appended claims. As already, noted, the quick revision apparatus 22 is not necessarily removably mounted to the rings. Also, it should be appreciated that the invention can be employed with types of ring binders other than that shown in the drawing. Also, it should be apparent that with multiple rings, the quick revision apparatus 22 is preferably, although not necessarily, used with the rings of a binder and that the guiding means is not necessarily mounted to the rings, themselves. Also, the bridge section 6A can be mounted to either ring 3A or 3B with the binder section 7 mounted to the other ring. Reference should therefore be to the appended claims for determining the scope of the invention.

I claim:

1. An apparatus for facilitating the quick revision of a bound set of ordered loose leaf elements releasably held together by a binding loop extending through mounting holes of the loose leaf elements adjacent edges thereof and having a pair of mating loop members movable between a closed position in which they are directly engaged with each other to close the binding loop with adjacent edges of the loose leaf elements held together at an interior of the loop and an open position in which ends of the mating loop members are spaced from each other to enable removal of the edges of the loose leaf elements from the interior of the loop, comprising:

a bridge for spanning the ends of the mating loop members when they are in said open position including a movable bridge section; and means for mounting the movable bridge section to an end of one of said pair of mating loop members for pivotal movement relative thereto between an open positioning which the bridge extends from the end of the one mating loop member away from the end of the other mating loop member and the ends of the mating loop members are not substantially spanned by the bridge to enable sliding removal of the loose leaf elements from off the end of the other one of said mating loop elements, and a closed position in which the ends of the mating loop members are substantially spanned by the bridge to enable sliding movement of the loose leaf elements from the end of the one mating loop member, across the bridge and onto the other one of said mating loop members.

2. The quick revision apparatus of claim 1 in which the bridge includes another bridge section having a mating end for substantial mating engagement with a mating end of the movable bridge section.

3. The quick revision apparatus of claim 2 in which the other bridge section and the movable bridge section have portions which overlap.

4. The quick revision apparatus of claim 1 in which the bridge extends from the end of the one mating loop member inwardly toward the interior of the loop.

5. The quick revision apparatus of claim 2 in which the other bridge section includes means for slidably mounting the other bridge section to the other one of said mating loop members.

6. The quick revision apparatus of claim 2 in which the other bridge section includes means for movably mounting the other bridge section to the end of the other one of said mating loop members.

7. The quick revision apparatus of claim 6 in which the other bridge section includes means for removably mounting the other bridge section to the other one of said mating loop members.

8. The quick revision apparatus of claim 2 in which the other bridge section is telescopically mounted to the end of the other one of said mating loop members.

9. The quick revision apparatus of claim 1 in which the bridge includes means for removably mounting the movable bridge section to the end of the one of the pair of loop members.

10. The quick revision apparatus of claim 9 in which the removable mounting means includes a mounting member removably attached to the end of the one of the pair of mating loop members, and means for pivotally mounting the movable bridge element to the mounting member.

11. The quick revision apparatus of claim 10 in which said mounting member includes means for slidably attaching it to the end of the one of the pair of mating loop members.

12. The quick revision apparatus of claim 11 in which said slidably attaching means includes means for telescopically fitting an end of the mounting member to the end of the one of the pair of mating members.

13. The quick revision apparatus of claim 12 in which the mounting member has an open hollow section for receipt therein of the end of the one of the pair of mating loop members.

14. The quick revision apparatus of claim 10 in which the mounting member has a peripheral edge around an open hollow section with a surface which gradually extends inwardly toward an interior of the hollow section to educe catching of the mounting holes thereon as they are slid thereby.

15. The quick revision apparatus of claim 10 in which the hollow section has a beveled end to reduce catching edges of the mounting holes thereon as they are slid thereby.

16. A method of revising a set of leaf elements releasably bound by means of a loop passing through a hole in each of the leaf elements defined by a pair of loop members movable relative to each other between a closed position in which the movable loop members are directly joined with each other to close the loop for preventing removal of the leaf elements and an open position in which there is a gap between the movable loop members to enable binding and removal of the leaf elements from the loop, comprising the steps of:

opening said pair of loop members from said closed position, thereby creating said gap;

mechanically guiding the leaf elements across the gap from one of the pair of loop members to the other of the pair of loop members;

moving the leaf elements across the gap while being guided until a selected leaf element is located on a selected loop member adjacent the gap;

selectively performing at least one of the steps of removing the selected leaf element from the selected loop member, and binding a new leaf element to the selected loop member.

17. The method of claim 16 in which said step of mechanically guiding the leaf elements across the gap includes the step of substantially spanning the gap with a movable bridge section while the leaf elements are moved across the gap.

18. The method of the claim 17 in which said step of spanning includes the step of moving the bridge section to a substantially nonspanning position, after said step of moving, to enable selective performance of said steps of removing and binding.

19. The method of claim 18 in which said step of moving includes the step of moving the bridge section with force transmitted thereto through at least one leaf elements being slid thereacross.

20. The method of claim 18 in which said step of moving the bridge section includes the step of lifting the bridge member with a leaf element passing thereacross from an open position in which it pivotally hangs from an end of the one of the pair of loop members other than the selected member to pivot it to a spanning position.

21. The method of claim 17 in which said step of spanning the gap includes the step of pivotally moving said bridge section in response to movement of a leaf element thereacross.

22. The method of claim 16 in which said step of moving the leaf element is performed manually.

23. The method of claim 16 in which said step of mechanically guiding the leaf elements includes the step of releasably attaching a guide to at least one of the loop members when the loop members are in an open position.

24. A loose leaf binder revision apparatus for facilitating the insertion and removal of leaf members in binding relationship with a loop extending through a mating hole in each of the leaf members defined by a pair of loop members movable relative to one another between a closed position, in which they are directly joined to prevent removal of the leaf members, to an open position, in which there is a gap between the loop members, to enable insertion and removal of leaf members in binding relationship therewith, comprising:

means, when in an operature condition, for mechanically guiding the leaf elements across the gap from one loop member to the other loop member; and means for enabling movement of the guiding means to said operative condition in response to movement of a leaf element across the gap.

25. The loose leaf binder revision apparatus of claim 24 in which said mechanically guiding means includes a bridge for spanning the gap.

26. The loose leaf binder of claim 25 in which said enabling means includes means associated with the bridge and engageable by a leaf element for moving the bridge to a position in which it closes said gap.

27. The loose leaf binder of claim 25 in which said enabling means includes means for pivotally mounting the bridge for pivotal movement between an open position, in which a significant portion of said gap remains open, and a closed position, in which the gap is substantially spanned in response to sliding movement of a leaf element thereacross.

* * * * *